US006357110B1

(12) United States Patent
Shipp et al.

(10) Patent No.: US 6,357,110 B1
(45) Date of Patent: Mar. 19, 2002

(54) STUD ELECTRICAL CONNECTION METHOD

(75) Inventors: Philip A. Shipp, West Bloomfield; Allen Dale Moring, Grosse Pointe Woods, both of MI (US)

(73) Assignee: Emhart Inc., Newark, DE (US)

( * ) Notice: Subject to any disclaimer, the term of this patent is extended or adjusted under 35 U.S.C. 154(b) by 0 days.

(21) Appl. No.: 09/451,583

(22) Filed: Nov. 30, 1999

Related U.S. Application Data

(60) Provisional application No. 60/114,410, filed on Dec. 31, 1998.

(51) Int. Cl.[7] ..... H01R 43/00

(52) U.S. Cl. ..... 29/825; 29/432.2; 29/520; 29/876; 29/512; 411/183; 411/179

(58) Field of Search ..... 439/801; 29/825, 29/432.2, 512, 520, 515, 798, 876, 460; 411/173, 183, 179

(56) References Cited

U.S. PATENT DOCUMENTS

| | | | | |
|---|---|---|---|---|
| 2,397,076 A | | 3/1946 | Keller et al. | |
| 3,290,982 A | | 12/1966 | Marschner | |
| 4,430,034 A | * | 2/1984 | Fujikawa | 411/179 |
| 4,707,567 A | | 11/1987 | Blaha | |
| 4,803,779 A | | 2/1989 | Blaha | |
| 4,865,499 A | | 9/1989 | Lacey | |
| 4,915,558 A | * | 4/1990 | Muller | 411/179 |
| 4,985,991 A | | 1/1991 | Finn | |
| 5,181,310 A | | 1/1993 | Josephson | |
| 5,207,588 A | * | 5/1993 | Ladouceur et al. | 439/84 |
| 5,499,449 A | | 3/1996 | Carter et al. | |
| 5,528,812 A | * | 6/1996 | Muller | 29/432.2 |
| 5,644,830 A | * | 7/1997 | Ladouceur et al. | 29/432.2 |

FOREIGN PATENT DOCUMENTS

GB 2274697 A 1/1994

OTHER PUBLICATIONS

Drawing from Gripco Fasteners, Emhart Fastening Teknologies, entitled Poplock Stud, Part No. D2025 (believed to have been offered for sale or publicly used on or about May 14, 1998).

Drawing from Gripco Fasteners, Emhart Fastening Teknologies, entitled Steel Poplock Sleeve, Part No. D2021 (believed to have been offered for sale or publicly used on or about May 8, 1998).

"Development and Application of a Fastening Method Using Plastic Working—Screw Fastening Method Using Staking –", Yoshio Nakabayashi, Tatsuya Ogawa, Osamu Tanigawa, Ryo Kato, pp. 1–6 (published prior to May 3, 1999).

* cited by examiner

*Primary Examiner*—Peter Vo
*Assistant Examiner*—Minh Trinh
(74) *Attorney, Agent, or Firm*—Harness, Dickey & Pierce, P.L.C.

(57) ABSTRACT

A stud electrical connection method is provided that employs a stud having a patterned external surface and a nut operably secured to the stud in a radially compressive manner, wherein the patterned external surface of the stud comprises a nonconductive coating on a portion thereof. Accordingly, installation of the nut onto the stud creates an electrically conductive path between an attached conductive member and a panel.

19 Claims, 6 Drawing Sheets

STUD ELECTRICAL CONNECTION METHOD

CROSS REFERENCE TO RELATED APPLICATIONS

This is a continuation-in-part of co-pending U.S. provisional patent application Ser. No. 60/114,410, filed on Dec. 31, 1998, which is incorporated by reference herein.

BACKGROUND OF THE INVENTION

This invention relates generally to an electrical connection and more specifically to an electrical connection for an automotive vehicle employing a weld stud.

It is common to arc weld an enlarged circular end of a threaded metal stud onto a sheet metal body panel of an automotive vehicle. Various parts are then inserted upon the single threaded stud and an internally threaded nut is rotationally inserted onto the stud. However, the nut installation is a time-consuming process which often leads to undesirably varying fastening forces.

Conventional threaded weld studs have also been employed as electrical grounding points for a vehicle wire harness to an engine compartment frame or panel. Traditionally, after the stud is welded onto the panel, the vehicle is dipped into an E-coat bath to obtain a corrosion resistant coating and then a spray paint coating is robotically applied. An elastomeric or plastic cap is typically secured onto the stud during the E-coat and paint processes in order to prevent the non-conductive coatings from adhering to the otherwise electrically conductive stud. After painting, the cap is manually removed and then an electrical eyelet is inserted onto the stud. A conventional internally threaded nut is rotated onto the stud by a manually operated torque wrench to secure the eyelet. Alternately, the nut itself can be used in place of the cap during the coating processes, however, the nut must then be removed and then reinstalled after the eyelet is mounted to the stud.

Screws have also been used to retain an electrical eyelet to a grounding panel. Conventional eyelets require upturned tabs to prevent rotation of the eyelets during installation of nuts for the stud construction or when screws are installed. This adds extra cost and complexity to the eyelet.

These traditional constructions are very labor intensive, especially when multiplied by the number of ground studs used in the vehicle. Quality control and repeatability are also difficult to maintain due to under-torquing of the nut or screw, loss of nuts or screws, inadequate prevention of paint in the conductive path, and other intermittent electrical failure concerns, especially when the installation is occurring on a quickly moving vehicle assembly line. It is noteworthy that the paint and E-coat are prone to clogging the threads on these conventional nuts and thereby causing the torque wrench to reach a shut off torque prior to the desired clamp load. Cross threading also causes premature torque wrench shut off.

It is also known to use a pneumatic tool to swage and compress an unthreaded metal nut or sleeve over an arc welded stud in a torque-free manner. This torque-free construction employs a two-part stud, separated by a reduced diameter neck. The tool pulls off the threaded end after the nut is secured to the remaining threaded part of the stud. The nut can be unscrewed and reused. Notwithstanding, it is not believed that such a swaged nut and stud system has been used for an electrical connection or for grounding, especially where a paint prohibiting cap has not been employed.

SUMMARY OF THE INVENTION

In accordance with the present invention, a preferred embodiment of a stud electrical connection employs a stud having a patterned external surface and a nut operably secured to the stud in a radially compressive manner. In another aspect of the present invention, installation of the nut onto the stud creates an electrically conductive path between an attached conductive member and a panel. In a further aspect of the present invention, the stud is an electrically grounding weld stud. Yet a further aspect of the present invention creates an electrically conductive path between a stud coated by a generally nonconductive material and a conductive nut. A method of assembling an electrical system using a coated stud and a conductive member engaged onto the stud through swaging is additionally provided.

The stud electrical connection of the present invention is advantageous over conventional constructions in that the present invention achieves reliable electrical conductivity between a coated stud and a nut without the need for extraneous caps or rotational initial assembly steps. Thus, the present invention reduces assembly time and cost while improving electrical reliability in a very repeatable manner. Stud welding feeder reliability is also improved due to the use of longer than typical ground studs prior to severing of the tool gripping end of the stud.

The stud electrical connection of the present invention is further advantageous over conventional devices in that the present invention employs a low cost nut since it does not employ internal threads prior to insertion upon the stud. Engagement of the nut onto the threaded stud does not require any torque upon the nut, thereby reducing the likelihood of inadvertent fracture of the weld between the stud and adjacent panel. Anti-rotational tabs on the eyelet are also not necessary. Moreover, the nut can be unscrewed and reused. Installation of the present invention nut is significantly quicker than conventional pre-threaded nuts, since the traditional nut run-down time is not required. Additional advantages and features of the present invention will become apparent from the following description and appended claims, taken in conjunction with the accompanying drawings.

DETAILED DESCRIPTION OF THE PREFERRED EMBODIMENTS

Figure 1:
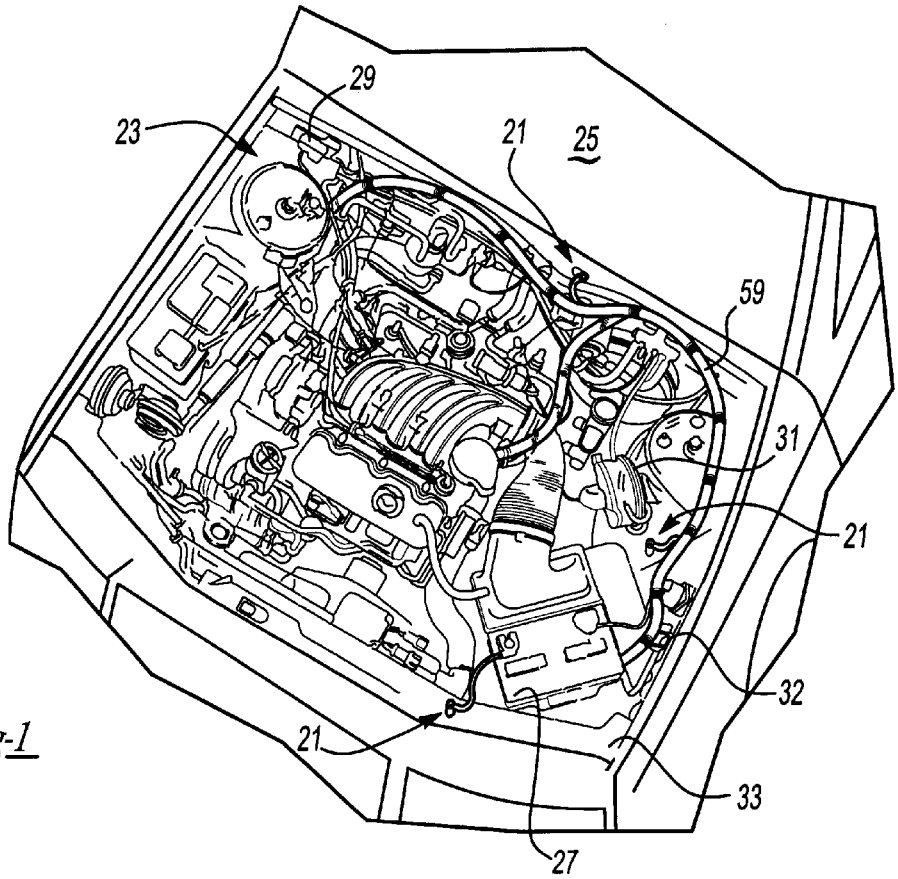
FIG. 1 is a perspective view showing an engine compartment of an automotive vehicle employing a first preferred embodiment of the stud electrical connection of the present invention.
Figure 2:
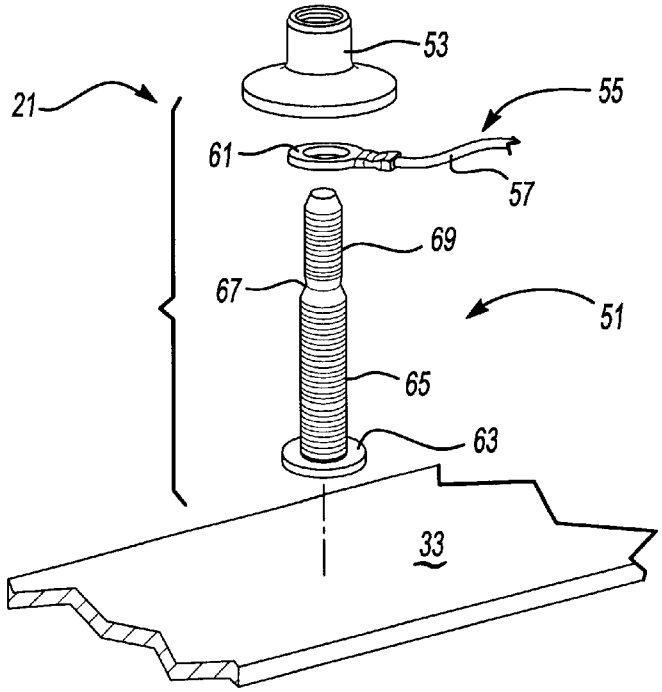
FIG. 2 is an exploded perspective view showing the preferred embodiment stud electrical connection of the present invention.
Figure 3:
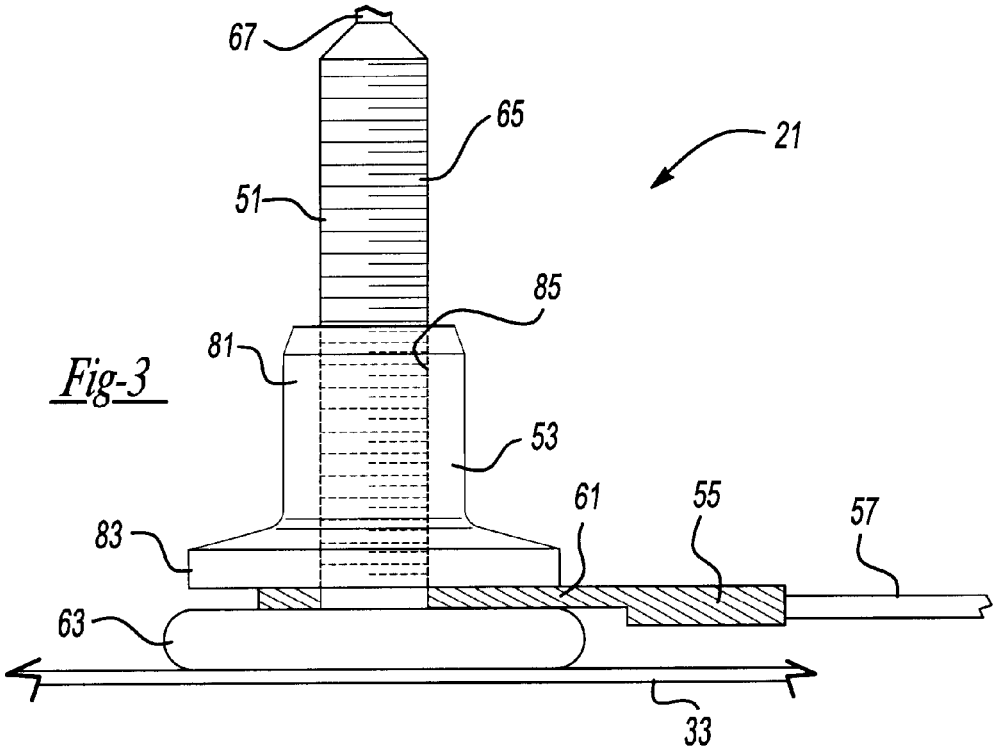
FIG. 3 is a side elevational view showing the first preferred embodiment stud electrical connection of the present invention.

FIG. 1 shows a stud electrical connection 21 of the present invention employed in an engine compartment 23 of an automotive vehicle 25. Stud electrical connection 21 is operable to conduct electricity from an electrical component, such as a battery 27, direct current window wiper motor 29, horn 31, power distribution box 32 or the like to a conductive metal panel or frame 33 of the vehicle.

Referring to FIGS. 2 through 5, the first preferred embodiment of the stud electrical connection 21 includes a weld stud 51, a nut 53, also known as a sleeve member, and an electricity conductor 55. Electricity conductor 55 is preferably a wire 57, branching from a wire harness 59 (see FIG. 1) with a generally circular metal eyelet terminal 61 crimped on an end thereof. Wire 57 is made of a flexible copper inner wire surrounded by an insulative casing.

Stud 51 includes a circular flange 63, extending in a lateral direction, a first threaded segment 65, a neck 67 and a second threaded segment 69. First threaded segment 65 has a M6.0×1.0 millimeter thread while second threaded segment 69 has a M5.0×0.8 millimeter thread. The threads define external engagement patterns on the stud. Furthermore, neck 67 has a reduced diameter and smaller lateral cross sectional area as compared to the threaded segments. Neck 67 is also provided with a 40 degree (total) angular taper x and a circumferential radius at the apex of the taper to define the reduced diameter section. Neck 67 has a breaking load of at least 500 kilograms and no more than 580 kilograms as applied in a linear manner along the longitudinal axis of stud 51. Stud 51 is preferably made from SAE 1010 steel with a zinc finish and has a cold rolled thread.

The first preferred embodiment nut 53 has a circular-cylindrical section 81 and an enlarged diameter flanged section 83. Nut 53 has a smooth and unthreaded internal aperture 85 prior to installation on stud 51. Nut 53 is preferably made from SAE 1010 steel with a tin zinc finish for the engine compartment.

Figure 7:
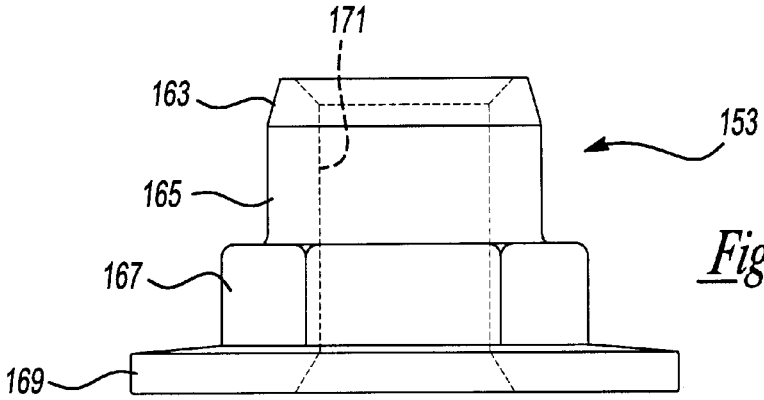
FIG. 7 is a side elevational view showing a nut employed in a second preferred embodiment stud electrical connection of the present invention.
Figure 8:
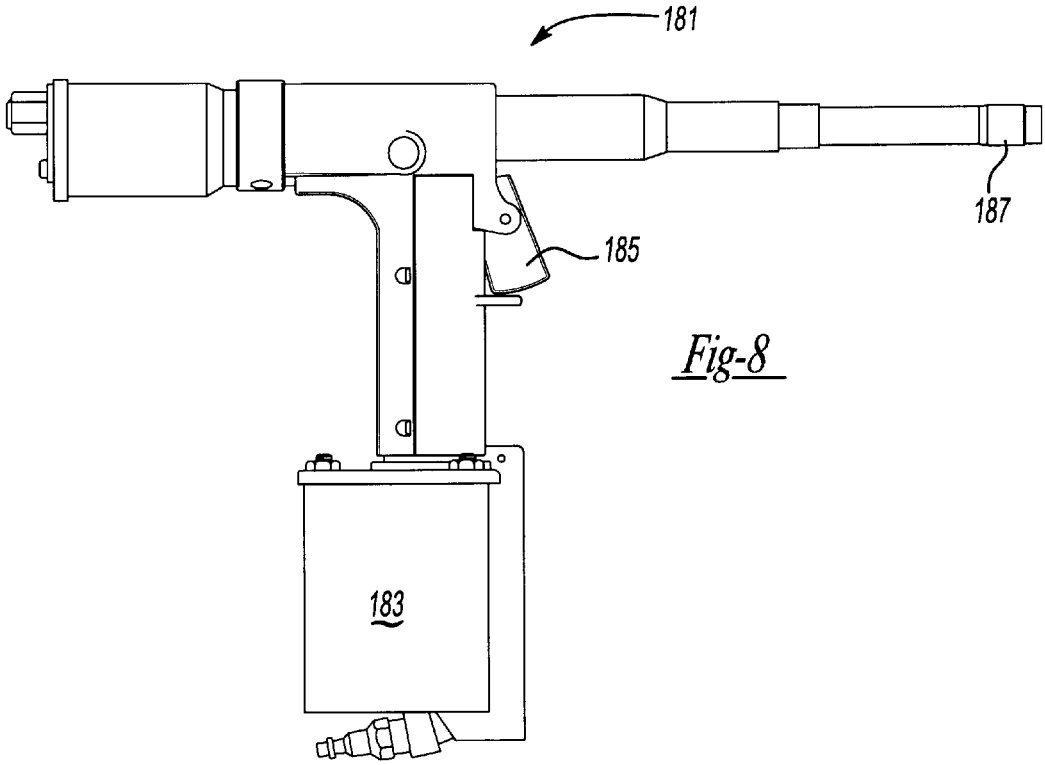
FIG. 8 is a side elevational view showing the preferred embodiment fastening tool used with the present invention stud electrical connection.
Figure 9:
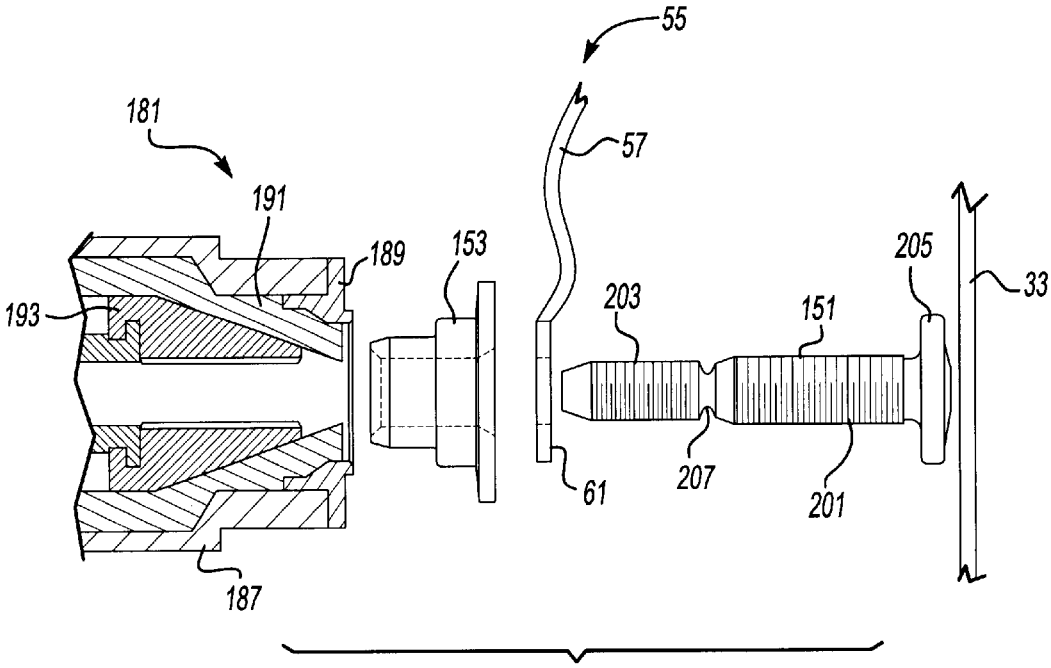
FIG. 9 is a partially fragmented and exploded, side elevational view showing the second preferred embodiment stud electrical connection of the present invention.
Figure 10:
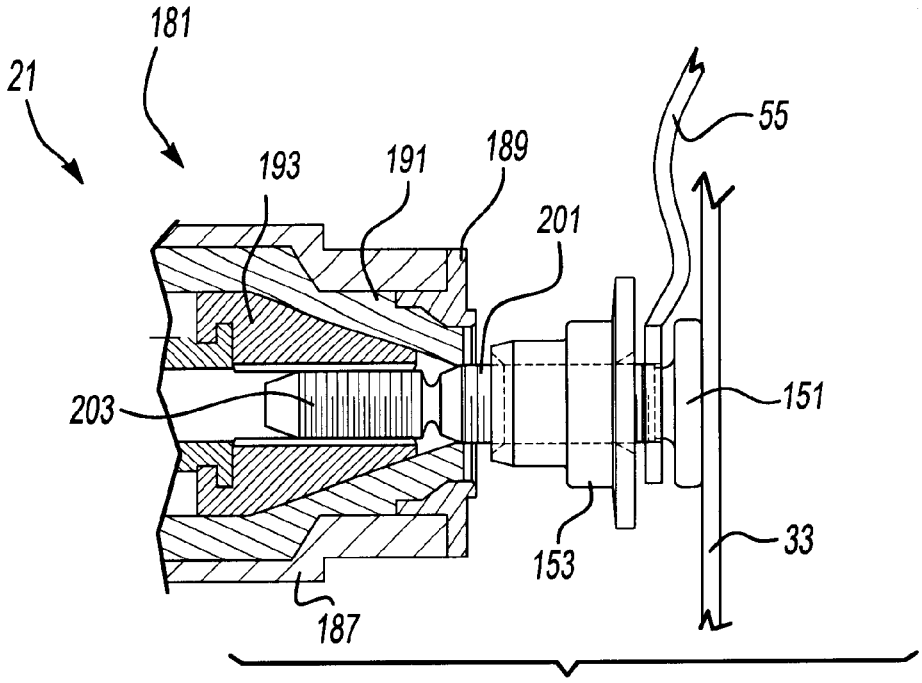
FIGS. 10–13 are a series of partially fragmented, side elevational views showing the assembly sequence of the second preferred embodiment stud electrical connection of the present invention.

FIG. 7 illustrates a second preferred embodiment nut 153. Nut 153 has an externally chamfered end 163, a circular-cylindrical section 165, a hexagonal wrench-receiving formation 167 and an enlarged diameter section 169. Nut 153 also has a smooth and unthreaded aperture 171 prior to installation onto a second preferred embodiment stud 151 (see FIG. 9).

A pneumatically actuated fastening/setting tool 181 is shown in FIGS. 8–13. Tool 181 employs a piston cylinder 183 and trigger 185 to operate parts inside a nose 187. Tool 181 uses a standard air pressure of about 85 or 100 psi to generate about 3,040–3,535 newtons of clamping force at the joint. Nose 187 of tool 181 further has a nose piece 189, jaw case 191 and jaw 193.

The sequence of fastening both preferred embodiment stud electrical connectors can be observed with reference to FIGS. 9–13. Exemplary stud 151 is fed into a collet of a weld head or gun (not shown) and the unit is cycled forward until the stud touches panel 33 thereby generating a "stud on work" signal to an electronic control unit. The weld gun subsequently lifts the stud approximately 1.2 millimeters off of the panel. A pilot arc is then generated to ionize an air gap between the proximal end of the stud and the panel. Next, the main welding current is turned on in order to generate molten material at the proximal end of the stud and at the surface of the panel. Finally, the weld gun then cycles forward to plunge the stud into the molten puddle of material. The molten weld puddle solidifies and the weld gun retracts, whereby the stud is permanently welded to the panel.

Figure 11:
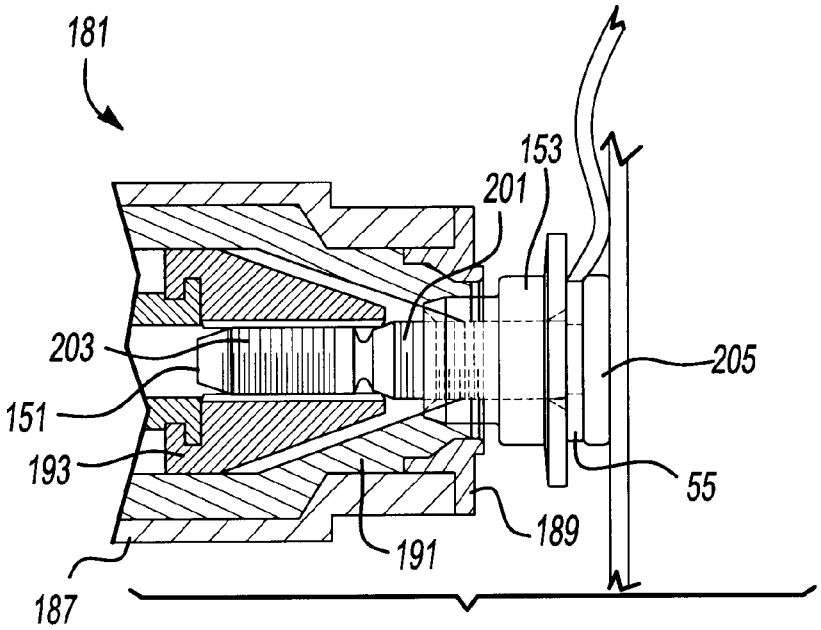

Next, eyelet 61 is coaxially aligned with and linearly inserted onto stud 151 whereby a hole within eyelet 61 is disposed around a first threaded segment 201 of stud 151. Nut 153 is then linearly slid over a second segment 203 of stud 151 and onto first segment 201. This can be observed by comparing FIGS. 9, 10 and 11. Tool 181 is linearly inserted onto stud 151 and nut 153. This step may be concurrent with the prior one. Referring to FIG. 11, second threaded segment 203, acting as a mandrel, is received inside of jaw 193 while nose piece 189 and a distal end of jaw case 191 surround the cylindrical section of nut 153. Next, jaw 193 firmly grips second threaded segment 203 while jaw case 191 linearly pushes nut 153 into desired abutting contact against eyelet 61, creating a linear preload instead of torque. Thus, eyelet 61 is longitudinally sandwiched between an end of nut 153 and a flange 205 of stud 151.

Figure 6:
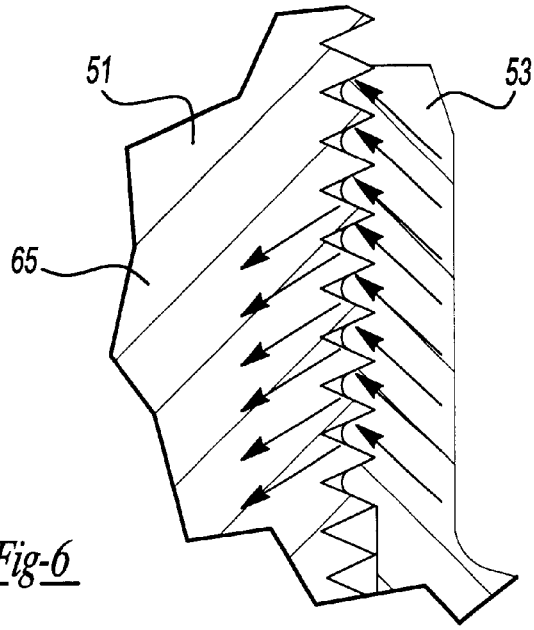
FIG. 6 is a fragmented cross sectional view, taken within circle 6 of FIG. 4, showing the first preferred embodiment stud electrical connection of the present invention.

Jaw case 191 is caused to swage and radially compress the cylindrical section of nut 153 in an inward lateral manner thereby forming threads on the aperture of nut 153 (see FIG. 6). This advantageously causes identically matching threads and eliminates the traditional problem of cross-threading of misaligned pre-threaded nuts and studs. Moreover, the tool does not significantly apply any rotational or torquing force upon stud 151 or nut 153 during initial fastening; this preserves the secure relationship of stud 151 to panel 33 and achieves accurate tolerances and repeatable quality of fastening forces to panel 33.

Figure 12:
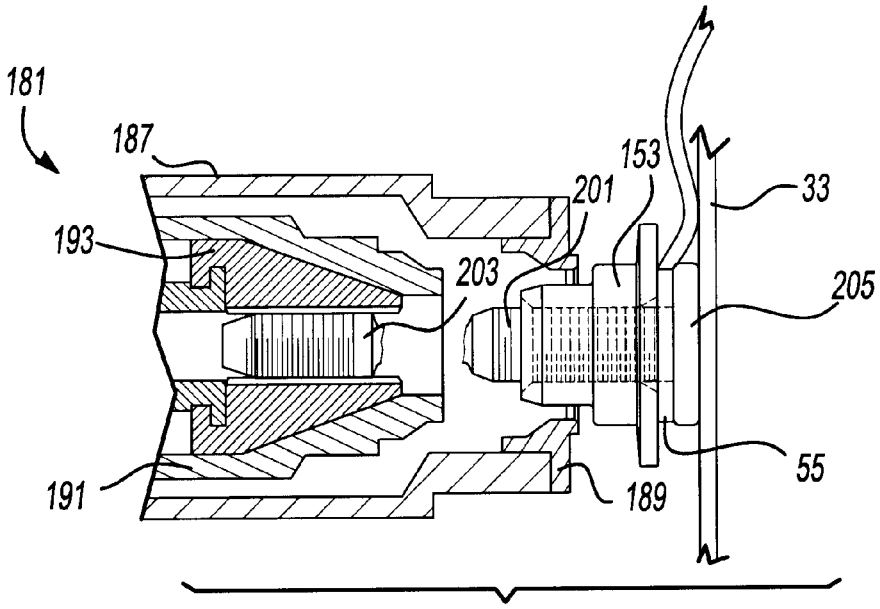
Figure 13:
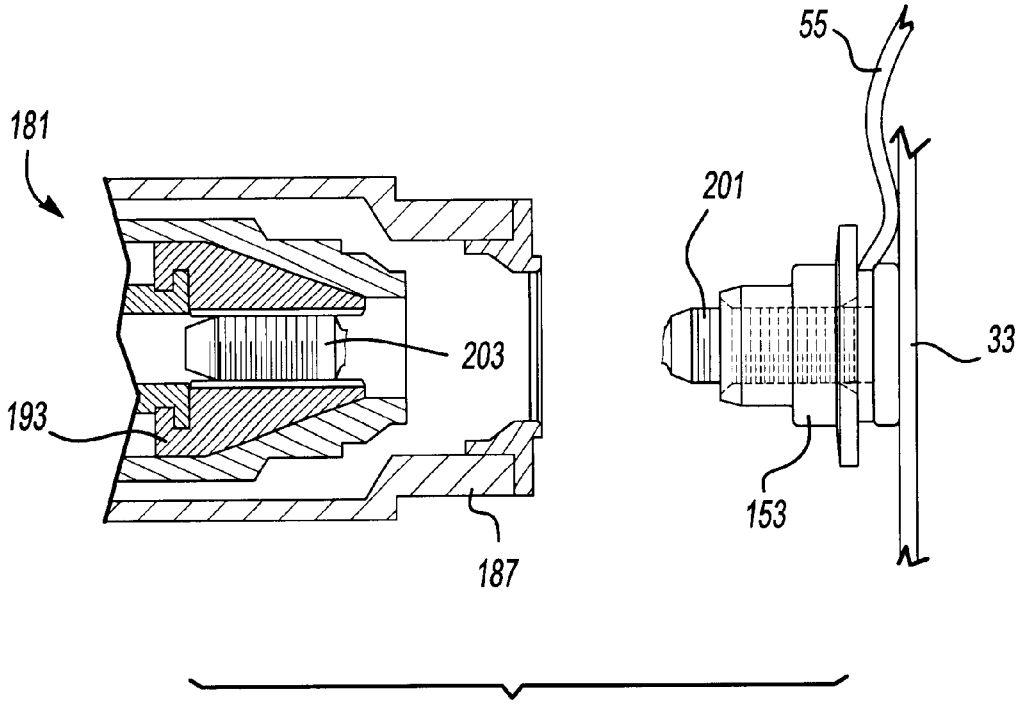

Finally, the comparison of FIGS. 11–13 demonstrates breaking of a neck 207 of stud 151, wherein jaw 193 which still retains second threaded segment 203, is linearly moved away from first threaded segment 201. Second segment 203 is then discarded. Nut 153 can thereafter be unscrewed from stud 151 by use of a wrench. It is expected that nut 153 can be reusable infinitely as long as the threads are not stripped.

More specifically, the electrical grounding assembly or connector of the present invention for the second embodiment includes a grounding stud welded to a panel, such as a vehicle body panel, and a hollow collar for electrically connecting a connector to the panel. The connector includes a through-hole through which the stud passes. The collar is made of metal such as steel. The collar comprises a flange having a size larger than the through-hole of the connector and a body portion to be swaged onto the stud. In this embodiment, a tool engagement portion of a hexagonal configuration, as viewed from the top, is formed on the sides between the flange and the body portion. The tool engaging portion is engaged with a tool, such as a wrench or the like, to facilitate the rotation for removing the attached collar. The flange is not necessary if an outer diameter of the portion is larger than that of the through-hole of the connector.

The connector is connected to the panel in the following manner. An inner diameter of the body portion of the collar is initially formed slightly larger than an outer diameter of the stud so as to be easily inserted into the stud. Therefore, the placement of the component on the panel and the insertion of the collar into the stud can be easily done on one side of the panel. In order to swage the collar onto the stud, the body portion of the collar is supported by a nose grip of a blind rivet setting tool, or a similar tool, and the tip of the stud is held with jaws of the tool and then the tool is actuated. Despite the action of the jaws to pull out the stud, the stud is firmly welded to the panel and remains fixed since the reaction force is against the flange of the stud and not the weld. Thus, the collar body portion is swaged while the grip presses the collar against the panel so that the inner diameter of the body portion is reduced to fit into the threads of the stud. Thus, the collar is attached to the stud. This method is more completely explained in PCT Publication No. WO 94/01687 and U.K. Patent Application No. 2,274,697.

In particular accord with the method of this invention, the stud is welded to the panel at an early stage in the manufacturing process before the panel has been covered by a coating, such as an undercoat or paint. Subsequently, the panel including the stud, is subjected to a coating process (such as an E-coat dip or robotic spraying) and the threads of the stud become generally covered with an insulative and generally non-conductive layer. By applying the swaged nut onto the stud in accordance with the present invention, the swaging force drives the metal nut against the threads of the stud, thereby displacing and piercing the coating and providing proper electrical connection between the eyelet and stud. The cutting action of the painted threads into the sleeve or nut, clears away enough paint at the interface to create a very low resistance joint, less than 0.5 milliohms, thereby eliminating the need to cover the stud through the paint process at the assembly plant.

Figure 4:
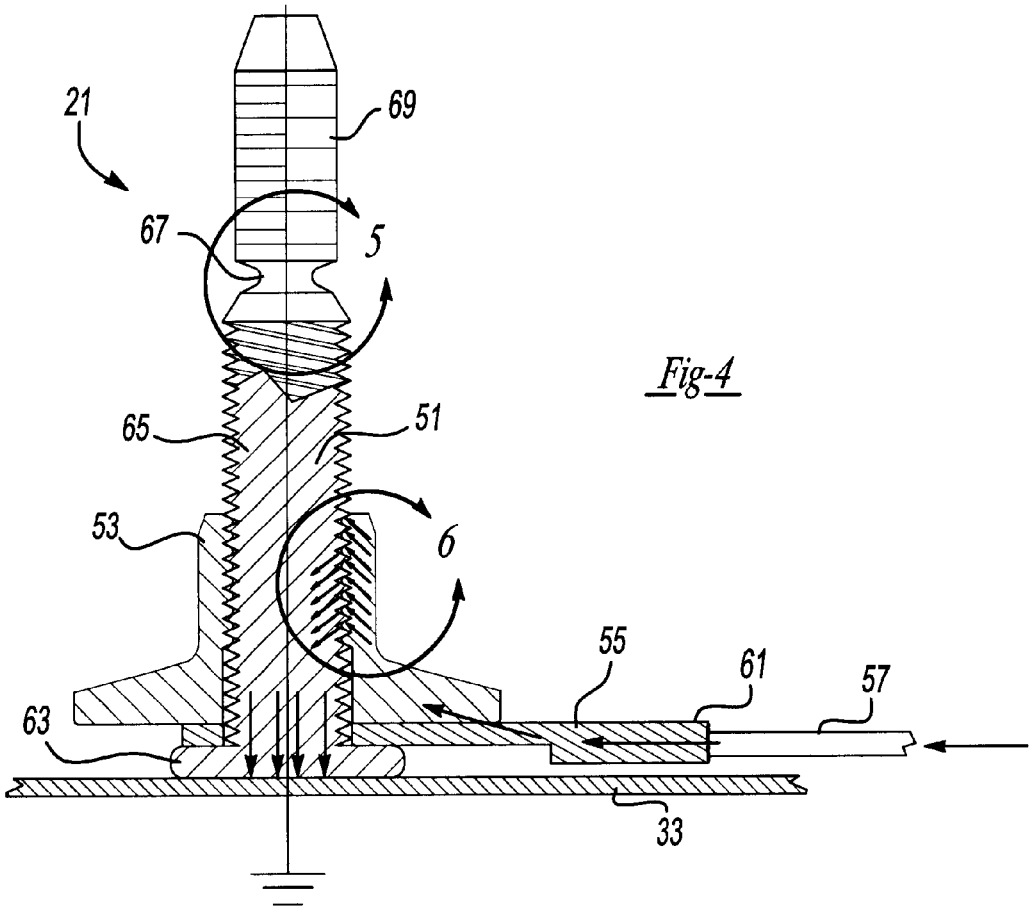
FIG. 4 is a partially fragmented, side elevational view showing the first preferred embodiment stud electrical connection of the present invention.
Figure 5:
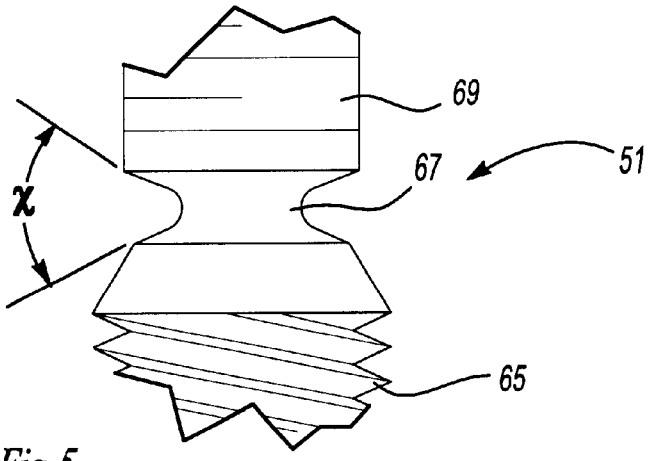
FIG. 5 is a fragmented side elevational view, taken within circle 5 of FIG. 4, showing a stud employed in the first preferred embodiment stud electrical connection of the present invention.

The electrical path can best be observed in FIGS. 4 and 6. When exemplary weld stud 51 is being employed as a grounding stud, the electricity will sequentially flow from the electrical component, through wire 57, through eyelet 61, through nut 53 (assuming that the paint coating insulates eyelet 61 from stud 51), into stud 51, and to panel 33. Although some paint or other coating may still be partially present between nut 53 and stud 51, enough will be removed to create an acceptable electrically conductive path.

While various embodiments of the stud electrical connection have been disclosed, it should be appreciated that other aspects can be employed within the scope of the present invention. For example, the wire and eyelet disclosed can be replaced by other electrical conductors such as circuit boards or elongated stampings. Furthermore, the stud electrical connection can be used for non-automotive apparatuses such as household appliances, power tools or industrial machines. It is also envisioned that a traditionally pre-threaded nut and torquing action can be used with the present invention stud, although many of the advantages disclosed herein will not be achieved. The presently disclosed stud can also be mounted to a power distribution box or other electrical component instead of to a vehicle body panel; thus, electricity can flow in an opposite direction to that shown in FIG. 4. It is envisioned that an electrical wire or conductor may be attached or soldered directly to the nut instead of employing a separate eyelet. Various materials and dimensions have been disclosed in an exemplary fashion, however, other material and dimensions may of course be employed. It is intended by the following claims to cover these and any other departures from the disclosed embodiments which fall within the true spirit of this invention.

The invention claimed is:

1. A method of assembling an electrical system, the system including a stud having an external pattern, an electrically conductive member and a panel, the method comprising:

(a) securing the stud to the panel;

(b) applying a coating to at least part of the external pattern of the stud;

(c) positioning the electrically conductive member at least partially around the stud after step (b);

(d) deformably compressing the electrically conductive member into engagement with the external pattern of the stud thereby fastening the electrically conductive member to the stud, at least part of the coating being located between the electrically conductive member and the corresponding engaged portion of the stud; and (e) conducting electricity between the electrically conductive member and the stud after step (d).

2. The method of claim 1 further comprising initially inserting the electrically conductive member onto the stud in a linear manner substantially free of rotation.

3. The method of claim 2 further comprising gripping an end of the stud by an installation tool during engagement of the electrically conductive member with the stud.

4. The method of claim 3 further comprising severing the gripped end of the stud from a remaining segment of the stud attached to the panel after the electrically conductive member is secured to the stud.

5. The method of claim 1 further comprising assembling an electrical terminal to the stud before compressing the electrically conductive member onto the stud, and securing the terminal to the stud by attachment of the electrically conductive member to the stud.

6. The method of claim 5 further comprising welding the stud to the panel.

7. The method of claim 1 further comprising rotating the electrically conductive member after the electrically conductive member is deformably compressed into engagement with the external pattern of the stud to remove the electrically conductive member from the stud.

8. The method of claim 7 further comprising rotating the electrically conductive member after the electrically conductive member is removed from the stud to reinstall the electrically conductive member onto the stud.

9. The method of claim 1 wherein the coating is substantially nonconductive.

10. The method of claim 9 wherein the coating is paint which is sprayed onto the panel and the majority of the external pattern of the stud.

11. The method of claim 1 further comprising using the panel to electrically ground the electricity conducted through the stud.

12. A method of completing a grounding connection in an automotive vehicle, the method comprising:

(a) welding a grounding stud having threads to an automotive vehicle frame part;

(b) applying a coating to the frame part and to the threads of the grounding stud;

(c) placing a grounding connector on the grounding stud; and (d) swaging a metal body onto the grounding stud and into tight engagement with the grounding connector, the metal body being driven into at least partial geometric conformity with the threads on the grounding stud and into electrical contact with the grounding stud to provide a continuous electrical path from the grounding connector, through the metal body, to the grounding stud and to the frame part.

13. The method of claim 12 wherein the swaging step drives the metal body into contact with the grounding stud by displacing the coating on the threads of the grounding stud.

14. The method of claim 12 further comprising severing an end segment of the grounding stud from a remaining segment of the grounding stud after the metal body is swaged onto the remaining segment.

15. The method of claim 12 wherein the coating is paint.

16. A method of grounding an electrical connection, the method comprising:

(a) securing a stud having external threads to an adjacent grounding member;

(b) applying a coating to at least part of the external threads;

(c) engaging a grounding connector with the stud; and (d) engaging a nut having internal threads with the external threads of the stud and with the grounding connector, the internal threads piercing at least part of the coating and being in contact with the external threads, wherein a continuous electrical path is provided from the grounding connector, through the nut, through the stud, and to the adjacent grounded member.

17. The method of claim 16, wherein the step of applying a coating further comprises applying the coating to the adjacent grounding member and the stud.

18. The method of claim 16 further comprising severing an end segment of the stud after the nut is engaged with the external threads of the stud and the grounding connector.

19. The method of claim 16 wherein the internal threads are engaged with the external threads by swaging.

* * * * *

UNITED STATES PATENT AND TRADEMARK OFFICE

CERTIFICATE OF CORRECTION

PATENT NO. : 6,357,110 B1 
DATED : March 19, 2002
INVENTOR(S) : Philip A. Shipp et al.

It is certified that error appears in the above-identified patent and that said Letters Patent is hereby corrected as shown below:

Column 6,
Line 8, after "stud", insert -- , after step (a) --.
Line 58, after "a", insert -- substantially non-conductive --.

Column 7,
Line 16, after "a", insert -- substantially non-conductive --.

Signed and Sealed this

Fourth Day of March, 2003

JAMES E. ROGAN
*Director of the United States Patent and Trademark Office*